US006708607B1

(12) United States Patent
Schwelling

(10) Patent No.: US 6,708,607 B1
(45) Date of Patent: Mar. 23, 2004

(54) BALING PRESS COMPRISING A TILTABLE COMPACTING CONTAINER, AND METHOD FOR OPERATING THE SAME

(76) Inventor: Hermann Schwelling, Hartmannweg 5, D-8862 Salem (DE)

( * ) Notice: Subject to any disclaimer, the term of this patent is extended or adjusted under 35 U.S.C. 154(b) by 0 days.

(21) Appl. No.: 10/009,136

(22) PCT Filed: Apr. 19, 2000

(86) PCT No.: PCT/EP00/03545

§ 371 (c)(1),
(2), (4) Date: Mar. 12, 2002

(87) PCT Pub. No.: WO00/63004

PCT Pub. Date: Oct. 26, 2000

(30) Foreign Application Priority Data

Apr. 19, 1999 (DE) ..... 199 17 634

(51) Int. Cl.[7] ..... B30B 13/00; B30B 1/00

(52) U.S. Cl. ..... 100/35; 100/229 A; 100/221; 100/218

(58) Field of Search ..... 100/229 A, 229 R, 100/225, 221, 219, 245, 295, 345, 346, 218

(56) References Cited

U.S. PATENT DOCUMENTS

| | | | | | |
|---|---|---|---|---|---|
| 2,386,929 | A | * | 10/1945 | Brown | 232/43.2 |
| 3,654,855 | A | * | 4/1972 | Longo | 100/229 A |
| 3,861,296 | A | * | 1/1975 | Clar | 333/238 |
| 3,946,661 | A | * | 3/1976 | Clar | 100/346 |
| 4,084,497 | A | * | 4/1978 | Khan | 100/345 |
| 4,275,651 | A | * | 6/1981 | Groth et al. | 100/229 A |
| 5,062,358 | A | * | 11/1991 | Fox | 100/218 |
| 5,421,252 | A | * | 6/1995 | Reichel | 100/193 |

* cited by examiner

*Primary Examiner*—Allen Ostrager
*Assistant Examiner*—Shelley Self
(74) *Attorney, Agent, or Firm*—Friedrich Kueffner

(57) ABSTRACT

A baling press includes a tiltable container arranged underneath a vertically guided compacting ram within a compacting frame, wherein the compacting container is tiltable forwardly about a horizontal shaft. As seen from a front wall of the compacting container, the longitudinal axis of the horizontal shaft is positioned behind a frontal plane extending through the center of gravity of the compacting plane. A unit for a tiltable support of the compacting container arranged on the shaft is fastened directly on the compacting container or on the frame. A locking unit engaging the compacting container is provided on a back side of the compacting frame.

5 Claims, 5 Drawing Sheets

BALING PRESS COMPRISING A TILTABLE COMPACTING CONTAINER, AND METHOD FOR OPERATING THE SAME

BACKGROUND OF THE INVENTION

1. Field of the Invention

The invention relates to a baling press with tiltable compacting container wherein above the compacting container a vertically guided compacting ram is arranged and wherein the compacting container can be filled in a forwardly tilted position via the exposed fill opening.

2. Description of the Related Art

From DE-OS 26 25 371 a device for compacting trash is already known comprising a compacting ram movable by means of a vertical guide, a pipe (compacting container) arranged underneath, onto which from below a bag-like container is pushed whose bottom is supported on a bottom plate during compacting, and comprising a device for emptying the compacted pipe contents of the pipe into the container, wherein the pipe together with the bottom plate can be tilted forwardly into a slanted position enabling filling. For tilting, an axle is arranged at the fill side below the bottom plate and, moreover, a grip is provided at the upper edge of the pipe. In order to move the pipe forwardly into the fill position, the operator must pull the pipe forwardly, according to the principle of moving a dolly, with a considerable force expenditure in the initial phase of tilting. Only in a later tilting phase, the lever principle of physics will act and the tilting action becomes easier. The complete tilting of the pipe to the front is prevented in that the rearward upper edge of the pipe impacts on the compacting ram guide of the device.

For a fluent working action during compacting of the trash it is furthermore disadvantageous that the operator first must tilt the pipe forwardly and can only then pick up the material for filling. Moreover, the device has the disadvantage that for emptying the compacted material the pipe must be moved upwardly by means of an additional guide unit so that its compacted contents can be emptied into the flexible receptacle pushed onto the pipe at the beginning of compacting, wherein the compacted material is again loosened and the volume increased.

Moreover, from U.S. Pat. No. 3,946,661 a device—press—for compacting household trash is known. This press has a press housing with an opening at the front side in which a tiltable unit—a container—is arranged which comprises a compacting container which can be positioned underneath a vertically guided compacting ram. The actual compacting container is an insert which is placed onto a bottom of the container so as to be aligned underneath a cylindrical ram guide which is arranged in the upper area of the container and has at the top and the bottom an opening, wherein the upper opening at the same time is the fill opening for dropping the trash. The cylindrical ram guide is at the same time the trash receptacle in which the trash is collected in preparation for compacting.

Said container, onto which the insert (compacting container) is placed, is pivotably supported on the housing by means of hinges whose axes are aligned with one another horizontally. In this device it is therefore not the compacting container that is tiltable about a horizontal axis but the additional receiving unit.

In contrast to the press of DE-OS 26 25 371 in this press a center of gravity displacement of the horizontal pivot axis is realized, but its pivot axis is arranged such that said entire unit, here also, can be tilted forwardly only by a manual actuation on the grip of the container. This device has also the disadvantages already mentioned above; moreover, the increased manufacturing expenditure is an additional disadvantage.

Known are also presses with compacting spaces to be filled from above, which have a compacting container with square or rectangular base surface and wherein, after the compacted bale is finished, at least two sidewalls of the compacting container must be tilted outwardly in order to remove the bale from the compacting space.

SUMMARY OF THE INVENTION

The object of the invention is thus to provide a baling press having a tiltable compacting container and being fillable from above in a forwardly tilted position, with which an operator is physically less stressed, which provides for a more fluent working action and which can be produced with minimal technical economic expenditure.

The object is solved by a baling press with tiltable compacting container according to the features of claim 1; the dependent claims 2 to 5 disclose further developments or advantageous constructive-technical embodiments of the invention, and claim 6 discloses new process steps for the operation of such baling presses.

Important in connection with the newly configured baling press with tiltable compacting container is primarily that a shaft that is provided on the compacting frame, which is preferably configured as a portal, and about which the compacting container as well as bearings, which are provided on or preferably below the bottom of the compacting container and which engage substantially peripherally the shaft, are arranged relative to one another such that the longitudinal axis of the shaft, viewed from an end face of the compacting container, is positioned in a frontal plane located preferably behind the center of gravity of the compacting container.

This aforementioned arrangement is selected especially such that the compacting container in the vertical position is almost in equilibrium, but has a small overweight in the pivoting/tilting direction, i.e., in the forward direction.

The compacting container is preferably locked by a locking unit in the vertical position required for compacting so that the compacting container (compacting space) and a preferably electro-hydraulically actuated, vertically movable compacting ram of the baling press are aligned with one another for a pressing cycle.

With respect to the method, it is furthermore provided in a novel way that upon return of the compacting ram into its upper position the locking unit is actuated such that the compacting container automatically tilts, here in the forward direction, into the filling position. According to a further embodiment, the locking unit is moreover also manually actuatable.

In a further technical development, at the backside of the compacting frame a spring unit is provided which is in active interaction with the compacting container such that, upon release of the compacting container, the compacting container receives an additional starting push for the tilting action and that, upon tilting of the compacting container into the vertical position, this spring unit moreover preferably acts as a damping element.

Further advantages and technical configurations of the novel baling press reside in the use of at least one pulse valve for the preferably employed electro-hydraulic drive of the compacting ram, in particular, for switching the compacting ram from the compacting stroke to lifting (returning) into its initial position.

Slots that are provided in the end face and in the back wall and correspond to one another allow tying of a compacted bale with a strap or wire while the compacting container is still closed. The pressing plate of the compacting ram, moreover, is configured such, as is known in the art, that tying of the bale is possible with the pressing plate positioned on the bale.

BRIEF DESCRIPTION OF THE DRAWINGS

The invention will be explained in detail in the following with embodiments illustrated schematically in the drawings. It is shown in:

FIG. 1: a novel baling press with tiltable compacting container in a frontal view;

DESCRIPTION OF THE PREFERRED EMBODIMENTS

Figure 1A:
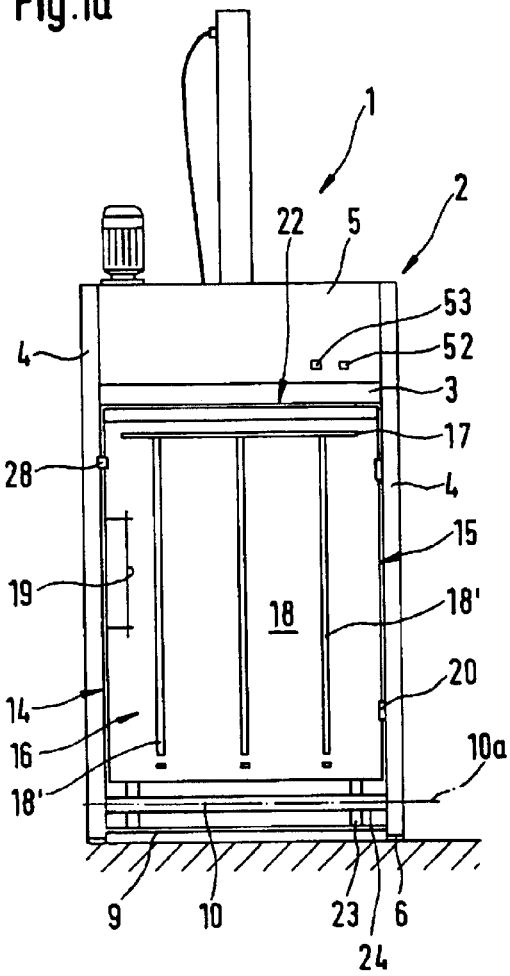
FIG. 1*a*: a novel baling press with tiltable compacting container in a frontal view.

In FIG. 1 the new baling press 1 is shown in a frontal view. The baling press 1 is comprised of a compacting frame 2 which comprises two lateral portal columns 4 facing one another; a bridge 3 horizontally arranged between the latter 4 in their head area; a transverse beam 9 in the foot area; and a horizontally arranged shaft 10 above the latter 9.

On, in, and above the bridge 3, a drive 47, an electro-hydraulically actuated lifting cylinder 48, as well as a controlling and signaling device, not illustrated in detail, are provided. A start switch 52 and a stop switch (emergency stop) 53 are arranged preferably on a front plate 5.

Figure 1B:
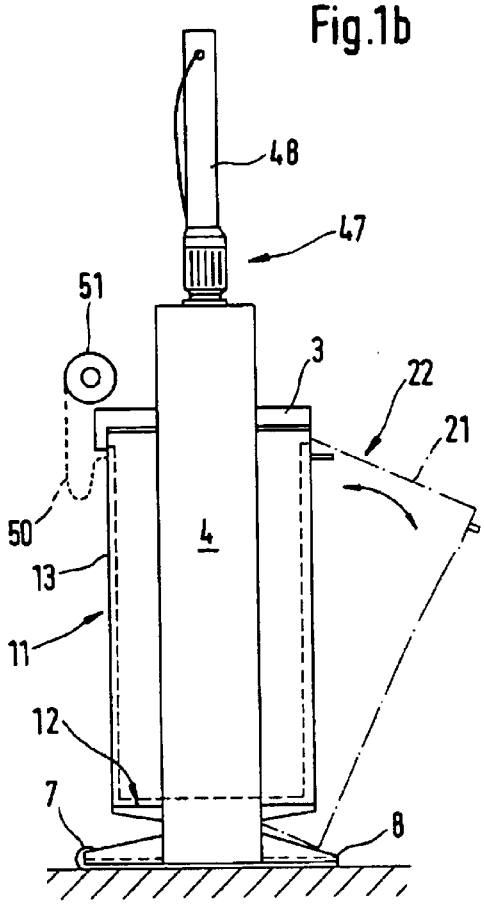
FIG. 1*b*: a side view of FIG. 1*a*, with indicated tilted position of the compacting container.

In the foot area of the portal columns 4 a foot part 6 is provided, respectively, which has at one end a wheel 7 and at the other end an adjusting element 8, as illustrated in FIG. 1*b*.

Between the portal columns 4 and above the horizontal shaft 10 a compacting container 11 is arranged which is secured in a tiltable way by means of two stays 23 arranged below on the container 11 which each have a bearing 24 engaging peripherally the shaft 10. FIGS. 1*a* and 1*b* also show that the compacting container 11 is comprised of a bottom 12, a back wall 13, two sidewalls 14 and 15 as well as an end wall 16 which together form an upwardly open compacting space. In the end wall 16 a door 18 is provided which can be locked by means of a door lock 19 and is tiltable about hinges 20 so that the compacting space can be opened for removing the finished compacted, preferably tied, bale after release of the door lock 19. Above the door 18 a grip 17 is provided on the end wall 16 for handling the compacting container 11. The upper edges of the compacting container parts 13, 14, 15 and 16 define the upwardly open fill opening 22.

According to the method it is now provided in a novel way that for releasing the fill opening of the tiltable compacting container 11 the vertically guided compacting ram 30 of the baling press 1 actuates a locking unit acting on the compacting container when the return stroke "R" following a pressing movement is carried out so that the released compacting container automatically tilts into a slanted position such that the fill opening 22 for filling the compacting space of the compacting container is substantially freely accessible.

On the backside of the compacting frame 2 at least one supply roll 51 for a tying strap 50 is secured. The tying strap 50 can be handled through slots 18' provided in the back wall 13 and end wall 16 before and after the compacting process.

On the left edge of the door 18 as well as on a corresponding location of the left portal column 4, parts of a signaling unit 28 are arranged. Upon tilting of the compacting container 11 in the forward direction for filling or upon opening of the door 18 for removing the bale, this signaling unit 28 sends a signal to the drive control which has the effect that the drive for the compacting ram 30 is switched off or, upon completion of the movement, is immediately stopped.

Figure 2:
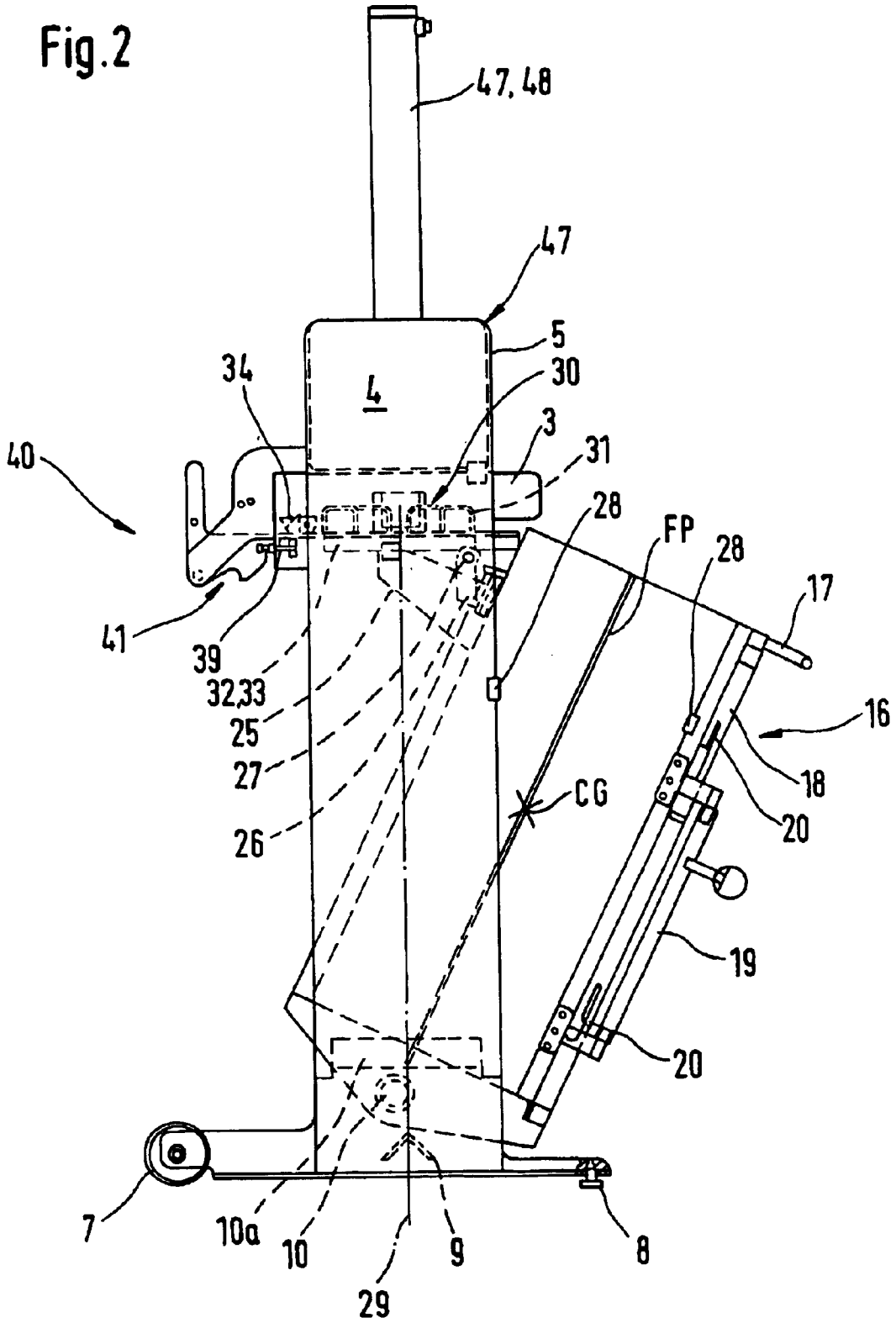
FIG. 2: a baling press modified in comparison to FIG. 1 with further details in a side view.

In FIG. 2 a side view of a modified embodiment of the novel baling press 1 illustrated in FIG. 1*a* and FIG. 1*b* as well as further components and modular units are illustrated in detail.

The compacting container is in the working position "filling", the compacting ram 30 is in its uppermost position, in the rest position. The compacting ram 30 is connected with its auxiliary frame 31, preferably comprised of U-shaped profiled sections, with the lifting cylinder 48 of the drive 47 and secures at its underside profiled rails 33 positioned parallel to the sidewalls 14 and 15 of the compacting container 11.

The profiled rails 33 have a tub-shaped cross-section wherein the open side is oriented downwardly, and several profiled rails 33 are arranged at a spacing adjacent to one another so that their slantedly extending legs form a V-shaped gap for guiding the tying strap, wherein, however, they are positioned so tightly adjacent to one another that they together form the pressing plate 32.

On the backside of the baling press 1, a locking unit 40 is arranged which is comprised of several elements, wherein a bolt 27 supported on a flange 26 and a dropping lock 25 are arranged on the back wall 13 of the compacting container 11 and a specially configured locking bolt 41 is provided at the backside of the bridge 3 of the compacting frame 2.

Moreover, in this FIG. 2 a vertically extending central axis 29 is illustrated which is a common axis for the compacting ram 30 and the compacting container 11 positioned vertically for the compacting process. The compacting ram 30 as well as the compacting container 11 are arranged centrally symmetrically relative to this central axis 29 such that the frontal plane extending through the center of gravity of the compacting container 11 is positioned on this central axis 29.

In addition to the novel and specially configured locking unit 40 it is important for the invention that the longitudinal axis 10*a* of the horizontal shaft 10, about which the compacting container 1 is tiltable, is positioned behind the central axis 29, i.e., behind the frontal plane FP of the compacting container 11 extending through the center of gravity CG.

Figure 3A:
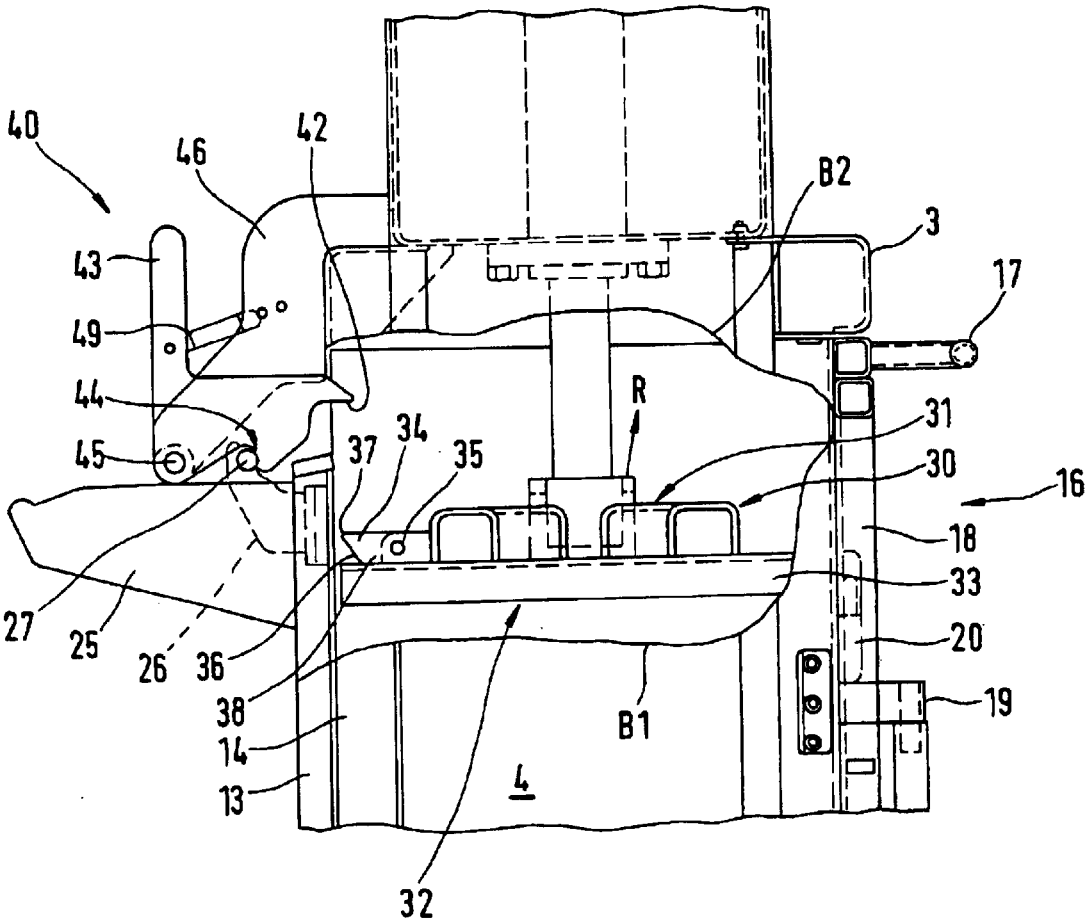
FIG. 3*a*–FIG. 3*c*: details of FIG. 2, respectively; compacting ram and compacting container in different working positions of a pressing cycle.
Figure 3B:
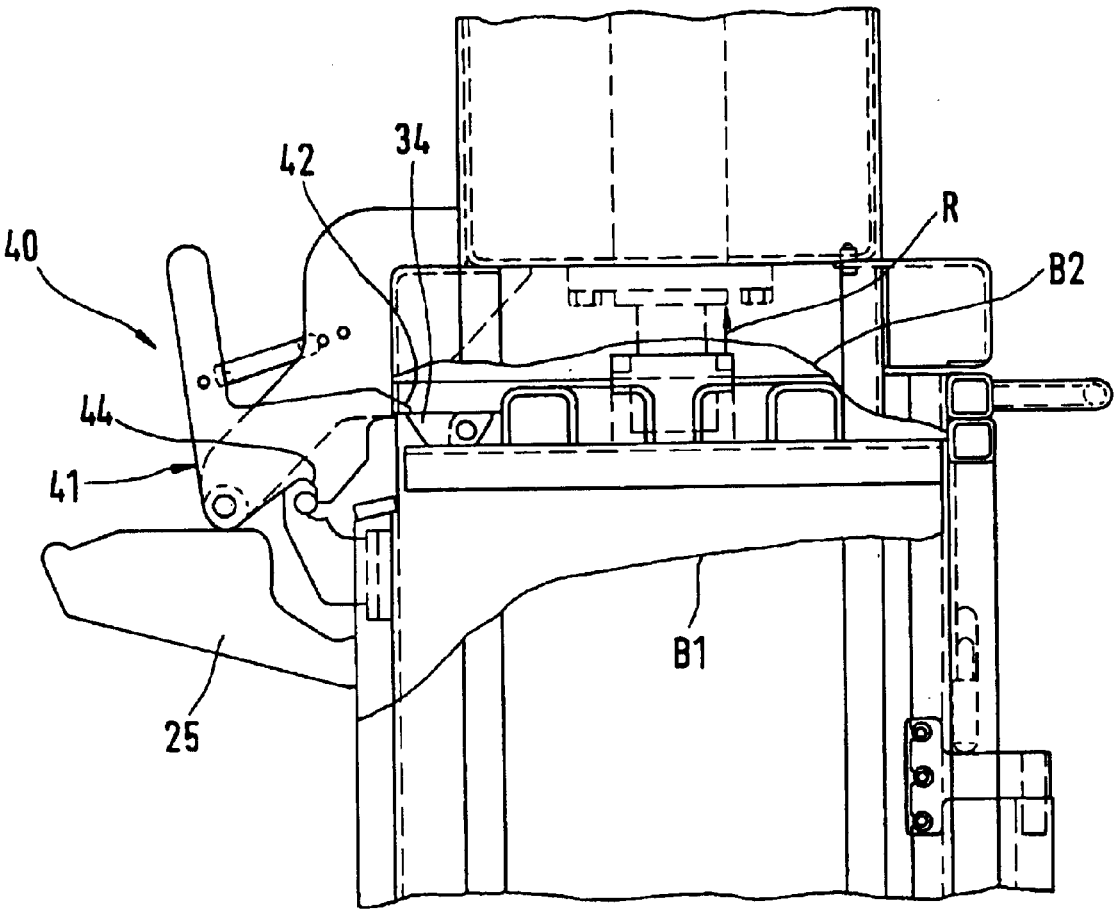
Figure 3C:
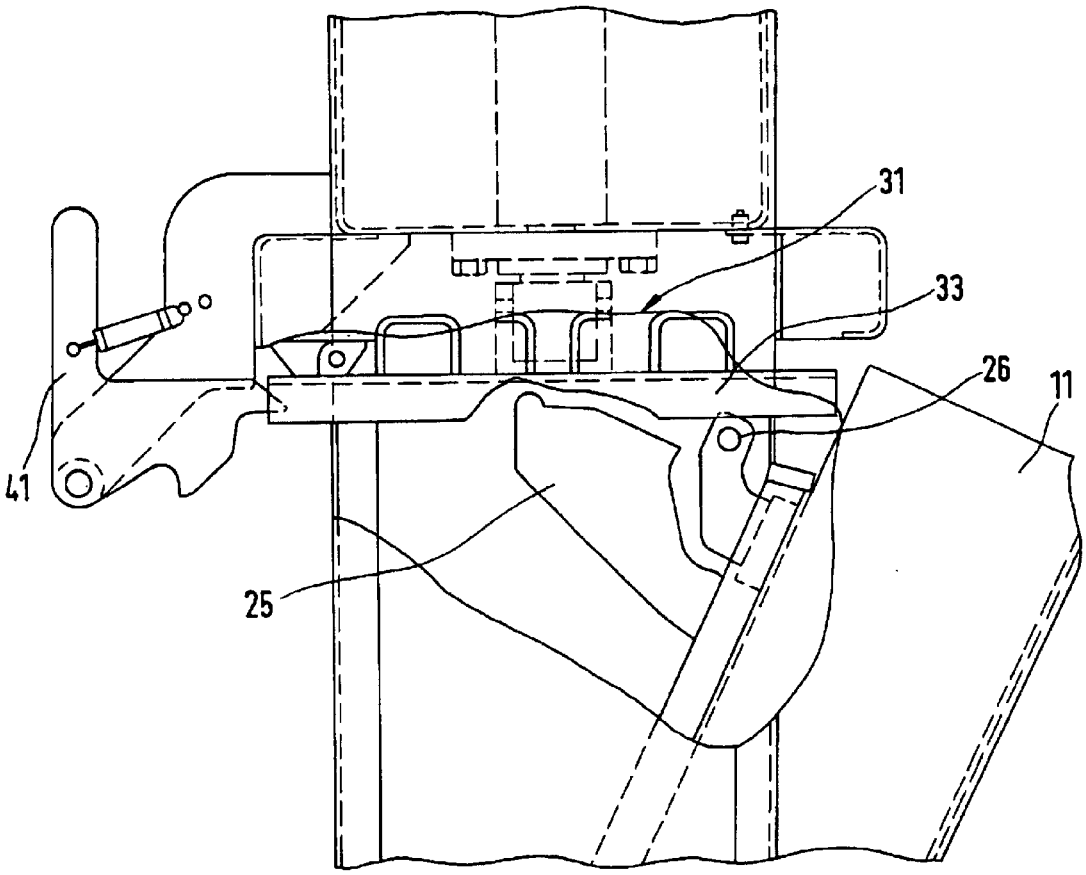

The details of the locking unit 40 as well as different working positions of the compacting ram 30 in connection with the locking unit 40 are illustrated in FIGS. 3*a* to 3*c*.

In FIG. 3*a* the compacting ram 30 moves again upwardly according to a partial cycle pressing in the direction "R". In the side view from the left showing portions of the baling press 1, which is illustrated in section along the section line "B1" and "B2", details of the locking unit 40 are illustrated.

The locking bolt 41 is pivotably supported by means of a bearing bolt 45 on a support 46 which is fastened on the backside of the bridge 3. The locking bolt 41 has moreover two legs arranged almost at a right angle to one another, wherein one leg in the end area has a nose 42 which penetrates through the back wall 13 into the compacting space to such an extent that it projects into the area of action of a pawl 34 pivotably arranged on the auxiliary frame.31. In the horizontally positioned lower side of the aforementioned leg a locking groove 44 is arranged which is positioned behind the back wall 13 and which in this working position engages across the bolt 27 arranged on the back wall 13 of the compacting container 11 and thus secures the compacting container 11 in the working position "pressing".

The upwardly oriented leg of the locking bolt 41, which is more narrow than the first described leg, is embodied as a hand grip 43. By means of a tension spring 49 engaging this hand grip 43 and the support 46, the other leg of the locking bolt 41, which is substantially horizontally positioned, is at all times forced by the locking groove 44 into the position "securing".

In the illustration according to FIG. 3*b* the compacting ram 30 has already moved farther upwardly, the pawl 34 engages a nose 42 of the locking bolt 41 and pivots it, by overcoming the spring force, about the bearing bolt 45 in the upward direction so that the locking groove 44 is also lifted and the bolt 27 is thus released.

After release of the bolt 27, see FIG. 3*c* in this context, the compacting container 11 pivots forwardly into the fill position as a result of the afore described special position of the horizontal shaft 10. The tilting movement carried out in the forward direction is limited by locking members, preferably provided with damping elements and preferably arranged on the portal columns 4, which engage the compacting container 11; the locking members have not been illustrated in the drawings.

The dropping lock 25, arranged on the back wall 13 and configured in the form of a rib, moves forwardly between two profiled rails 33 during the tilting movement of the compacting container 11 and rests in the completely tilted position of the compacting container 11 underneath a transverse part of the auxiliary frame 31.

The dropping lock 25 prevents that the compacting ram 30 can drop below a predetermined position and ensures thus that at any time the compacting container 11 can be moved by manual actuation again into the position "pressing", i.e., into a vertical position. Moreover, it is illustrated that, after passing the pawl 34, the bolt 41 drops into its initial position. When the pressing plate 32 begins the compacting stroke and moves downwardly, the slanted portion 36 of the pawl 34 moves along the slanted portion of the nose 42, pivots during this movement upwardly about the pivot axis 35 and drops, after passing the nose 42, again into its initial position, wherein its lower surface 38 is supported preferably on a profiled rail 33.

All of the features mentioned in the preceding description as well as the features that can be taken only from the drawings are further components of the invention, even if they are not especially emphasized and, in particular, are not mentioned in the claims. The invention is not limited to the embodiment but is variable in many ways within the frame of the disclosure.

list of Reference Numerals

1 baling press (with tiltable compacting container)
2 compacting frame
3 bridge
4 portal columns
5 front plate
6 foot parts
7 wheel
8 adjusting element
9 transverse beam
10 horizontal shaft
10*a* longitudinal axis
11 compacting container
12 bottom
13 back wall
14 sidewall, left
15 sidewall, right
16 end wall
17 grip
18 door
18' slots
19 door lock
20 hinges
21 upper edge
22 fill opening
23 stays
24 bearing
25 dropping lock (rib)
26 flange
27 bolt
28 signaling unit
29 central axis
30 compacting ram
31 auxiliary frame (U-shaped profiles)
32 pressing plate
33 profiled rails (tub-shaped cross-section)
34 pawl
35 pivot axis
36 slanted portion
37 upper surface
38 lower surface
39 spring unit
40 locking unit
41 locking bolt
42 nose
43 hand grip
44 locking groove
45 bearing bolt
46 support
47 drive
48 lifting column (hydraulically movable)
49 tension spring
50 baling strap
51 supply roll
52 start button
53 stop button (emergency stop)
B1, B2 section lines
R direction, movement of compacting ram

What is claimed is:

1. A baling press comprising a tiltable compacting container mounted in a compacting frame substantially surrounding the compacting container, the compacting frame having a front side and a back side, a vertically guided compacting frame, a vertically guided compacting ram, wherein the compacting container is arranged underneath the vertically guided compacting ram and is tiltable forwardly about a horizontal shaft, wherein, as seen from a front wall of the compacting container, a longitudinal axis of the horizontal shaft is positioned behind a frontal plane extending through a center of gravity of the compacting container, means for a tiltable support for a compacting container arranged in the shaft being fastened directly on the compacting container or the frame, further comprising a locking unit engaging the compacting container mounted on the back side of the compacting frame and a pawl mounted on the compacting ram for actuating the locking unit.

2. The baling press according to claim 1, further comprising a rib-shaped dropping lock mounted on a back wall of the compacting container.

3. The baling press according to claim 2, further comprising a spring unit configured to act on the compacting container mounted on the back side of the compacting frame.

4. The baling press according to claim 1, comprising damping elements mounted in the compacting frame for limiting the tilting movement of the compacting container, wherein the damping elements partially engage areas of the compacting container.

5. A method for releasing an opening of a fill shaft of a tiltable compacting container of a baling press with a vertically guided compacting ram, wherein the compacting container is arranged underneath the vertically guided compacting ram and is tiltable forwardly about a horizontal shaft, wherein, as seen from a front wall of the compacting container, a longitudinal axis of the horizontal shaft is positioned behind a frontal plane extending through a center of gravity of the compacting container, the method comprising, when a return stroke following a pressing movement is carried out, the compacting ram of the baling press actuating a locking unit engaging the compacting container, such that the released compacting container automatically moves into a slanted position in which the opening of the fill shaft is substantially freely accessible.

* * * * *